US009044768B2

(12) United States Patent
Pouliaude

(10) Patent No.: US 9,044,768 B2
(45) Date of Patent: Jun. 2, 2015

(54) FLUID DISPENSER

(71) Applicant: APTAR FRANCE SAS, Le Neubourg (FR)

(72) Inventor: Florent Pouliaude, Fouqueville (FR)

(73) Assignee: APTAR FRANCE SAS, Le Neubourg (FR)

( * ) Notice: Subject to any disclaimer, the term of this patent is extended or adjusted under 35 U.S.C. 154(b) by 9 days.

(21) Appl. No.: 14/067,243

(22) Filed: Oct. 30, 2013

(65) Prior Publication Data

US 2014/0124538 A1 May 8, 2014

Related U.S. Application Data

(60) Provisional application No. 61/738,140, filed on Dec. 17, 2012.

(30) Foreign Application Priority Data

Nov. 6, 2012 (FR) ..... 12 60513

(51) Int. Cl.
*B67B 1/00* (2006.01)
*B65D 88/54* (2006.01)
(Continued)

(52) U.S. Cl.
CPC ..... *B05B 11/0008* (2013.01); *B05B 11/0054* (2013.01); *B05B 11/3043* (2013.01); *B65D 83/384* (2013.01)

(58) Field of Classification Search
CPC ..... B65D 83/0005; B65D 2583/005; B65D 55/02; B65D 55/022; B65D 55/12; B65D 83/384; B65D 83/386; B65D 2255/20; B05B 11/0008; B05B 11/0054; B05B 11/3043; B05B 11/3045; B05B 11/3046; B05B 11/3047; B05B 11/3042
USPC ..... 222/173, 183, 325, 320–321.9, 384, 222/383.1–385; 220/295, 301, 302, 293, 220/288, 212; 215/329, 318, 317, 316, 287, 215/280, 273; 604/72
See application file for complete search history.

(56) References Cited

U.S. PATENT DOCUMENTS 3,165,220 A * 1/1965 Haynes ..... 215/252
3,420,413 A * 1/1969 Corsette ..... 222/107
(Continued)

FOREIGN PATENT DOCUMENTS

WO 2007/022898 A2 3/2007

OTHER PUBLICATIONS

French Search Report issued in Application No. 1260513 dated Jul. 3, 2013.

*Primary Examiner* — Paul R Durand
*Assistant Examiner* — Benjamin R Shaw
(74) *Attorney, Agent, or Firm* — Sughrue Mion, PLLC

(57) ABSTRACT

A fluid dispenser including a casing having a mounting mechanism (2), a connection mechanism (3), and a cylinder (4) with an insertion-and-removal opening (48) defining an axis X; a dispenser member (5) received in the mounting mechanism (2); and a fluid reservoir (6). The reservoir (6) includes a bottom wall (61) accessible at the insertion-and-removal opening (48). The connection mechanism (3) has a reception collar (7), the reception collar (7) guided in axial movement in the cylinder (4) along the axis X against the action of a spring (9). The connection mechanism (3) includes a ring (8) arranged between the reception collar (7) and the spring (9), the ring (8) engaging both the cylinder (4) and the reception collar (7) and responsive to pressure applied against the bottom wall (61) of the reservoir (6), by switching between a locked position and a free position.

11 Claims, 3 Drawing Sheets

(51) Int. Cl.

| | |
|---|---|
| ***G01F 11/00*** | (2006.01) |
| ***B05B 11/00*** | (2006.01) |
| *B65D 83/38* | (2006.01) |

(56) References Cited

U.S. PATENT DOCUMENTS

| | | | | |
|---|---|---|---|---|
| 4,449,647 | A * | 5/1984 | Reed et al. | 222/153.09 |
| 5,277,340 | A * | 1/1994 | Van Brocklin | 222/321.7 |
| 5,516,006 | A * | 5/1996 | Meshberg | 222/25 |
| 6,338,422 | B1 * | 1/2002 | DeJonge | 222/162 |
| 6,578,573 | B2 * | 6/2003 | Koch | 128/202.27 |
| 6,918,512 | B2 * | 7/2005 | Kondoh | 222/153.09 |
| 6,945,958 | B2 * | 9/2005 | Stewart | 604/110 |
| 7,780,043 | B2 * | 8/2010 | Jourdin et al. | 222/321.9 |
| 7,874,461 | B2 * | 1/2011 | Bae | 222/153.13 |
| 8,308,029 | B2 * | 11/2012 | Ki | 222/309 |
| 2004/0015126 | A1 * | 1/2004 | Zierenberg et al. | 604/72 |
| 2008/0023498 | A1 * | 1/2008 | Bertin et al. | 222/402.12 |
| 2010/0089950 | A1 * | 4/2010 | Helf et al. | 222/153.09 |
| 2012/0024899 | A1 * | 2/2012 | Michaux et al. | 222/153.13 |
| 2012/0068030 | A1 * | 3/2012 | Behar | 248/224.7 |
| 2013/0200107 | A1 * | 8/2013 | Presche | 222/153.13 |
| 2014/0027474 | A1 * | 1/2014 | Dumont et al. | 222/321.1 |
| 2014/0042189 | A1 * | 2/2014 | Brahim et al. | 222/321.1 |

* cited by examiner

FLUID DISPENSER

CROSS REFERENCE TO RELATED APPLICATION

This application claims the benefit under 35 U.S.C. §119 (e) of U.S. provisional patent application Ser. No. 61/738,140, filed Dec. 17, 2012, and priority under 35 U.S.C. §119 (a)-(d) of French patent application No. FR-12 60513, filed Nov. 6, 2012.

TECHNICAL FIELD

The present invention relates to a fluid dispenser comprising a dispenser member, such as a pump or a valve, that is held by reception means on a fluid reservoir. Such a dispenser is frequently used in the fields of perfumery, cosmetics, and even pharmacy in order to dispense fluids, such as perfumes, creams, lotions, etc.

BACKGROUND OF THE INVENTION

In the prior art, dispensers are already known having a fluid reservoir that is in the form of a cartridge refill that is connected in removable manner to the dispenser member or to the reception means of the dispenser member. Thus, the reservoir, once empty, may be replaced by a full reservoir. In order to enable a reservoir to be connected and disconnected, connection means of the snap-fastener or screw-fastener type are frequently used. This means that it must be possible to hold the reservoir firmly enough to unscrew it or to unsnap-fasten it. To do this, it is necessary for at least a significant portion of the reservoir to remain accessible, and thus visible, and this can be detrimental to the overall appearance of the dispenser.

An object of the present invention is to define a fluid dispenser having a removable reservoir that can be connected to the dispenser member and disconnected therefrom without having to hold it firmly. Another object of the present invention is to perform the connection and disconnection while only the bottom of the reservoir is accessible. Another object of the present invention is to mask the reservoir over its entire height, except at its bottom, while making it possible to connect and disconnect it from the dispenser member. Another object of the present invention is to enable connection and disconnection without having to exert considerable force, as when unsnap-fastening or unscrewing prior-art reservoirs and refills. Still another object of the present invention is to guarantee to the user that the reservoir is either connected or disconnected without an intermediate step or state.

BRIEF SUMMARY OF THE INVENTION

To achieve the various objects, the present invention proposes a fluid dispenser comprising: a casing comprising mounting means, connection means, and a cylinder provided with an insertion-and-removal opening and defining an insertion and removal axis; a dispenser member, such as a pump or a valve, that is received in the mounting means; and a fluid reservoir that is engaged in the cylinder through the insertion-and-removal opening, and that is connected to the dispenser member in removable manner by means of the connection means, the reservoir including a bottom wall that is accessible at the insertion-and-removal opening; the dispenser being characterized in that the connection means comprise a reception collar in which a portion of the reservoir is received, the reception collar being guided in axial movement in the cylinder along the insertion and removal axis against the action of a spring, the connection means further comprising a ring that is arranged between the reception collar and the spring, the ring coming into engagement both with the cylinder and the reception collar so as to respond to pressure being applied against the bottom wall of the reservoir, by switching between a locked position in which the reservoir (6) is connected to the dispenser member, and a free position in which the reservoir may be removed from the cylinder.

Thus, merely by pressing axially on the bottom wall of the reservoir, the user is guaranteed to switch from the locked position to the free position, or from the free position to the locked position, without any other intermediate position. Since switching between the locked position and the free position can be obtained merely by pressing on the bottom wall of the reservoir, the cylinder may surround the reservoir completely, with it being possible for its accessible bottom wall optionally to be arranged inside the cylinder in the proximity of the insertion-and-removal opening. In the connection means, the reception collar, as its name indicates, is used to receive the reservoir, the spring is used to exert an opposing force, and the collar arranged between the cylinder and the spring is used to guarantee the locked and free positions induced by the opposing forces exerted by the collar and the spring.

Advantageously, the ring is mounted to turn relative to the reception collar and to the cylinder, the reception collar urging the ring to turn when the reception collar is thrust axially against the ring. In other words, in addition to its function of receiving the reservoir, the reception collar serves to turn the ring. Advantageously, the ring is guided in axial movement in the cylinder over a determined axial stroke, the ring being released from the axial guidance when the reception collar is thrust axially against the ring over a stroke that is greater than the determined axial stroke. Preferably, the cylinder urges the ring to turn over a limited angular stroke when it is released both from the axial guidance of the cylinder and from the axial thrust of the reception collar. The force exerted by the spring is constant, whereas the axial thrust induced by the reception collar is temporary, such that the ring is subjected to forces of different intensities and directions.

In a practical embodiment, the cylinder includes axial guide grooves that are distributed over an inner wall, the reception collar including guide tabs that are engaged in the axial guide grooves of the cylinder, such that the reception collar slides axially in the cylinder without any turning component. In addition, the ring may include guide splines that are engaged in the axial guide grooves of the cylinder above the guide tabs, each axial guide groove presenting an open top end, the guide splines being moved beyond the open top ends so that the ring is released from the axial guidance of the cylinder. Advantageously, the open top ends of the axial guide grooves are interconnected by locking-and-unlocking paths over which the guide splines of the ring pass under the action of the spring as soon as the axial thrust of the reception collar is relaxed, the guide splines being released from the axial guide grooves by the axial thrust of the reception collar that turns the ring so that its guide splines engage on the locking-and-unlocking paths as soon as they are released from the axial guide grooves of the cylinder. Preferably, the reception collar includes a crenelated annular edge having successive descending slopes that are separated by peaks and troughs, the ring including lugs that are engaged on the descending slopes when the reception collar is thrust axially against the ring, in such a manner as to urge the ring to turn relative to the reception collar.

Still more concretely, each locking-and-unlocking path may comprise a sloping locking section and a sloping unlocking section that are separated by a stop section, each of the locking-and-unlocking sections communicating with a directly-adjacent axial guide groove, the guide splines of the ring presenting bottom ends that are advantageously sloping and that slide, from their free position, into the axial guide grooves under the axial thrust of the reception collar, that engage, on leaving the axial guide grooves, against the locking sections under the turning action of the reception collar, that slide over the locking sections under the action of the spring, that are blocked by the stop sections in the locked position, that are moved axially by the axial thrust of the reception collar, that engage against the unlocking sections under the turning action of the reception collar, that slide over the unlocking sections under the action of the spring, and that then engage in the axial guide grooves under the action of the spring, into their free position.

In another aspect of the invention, the reservoir includes a fastener profile that is suitable for coming into releasable engagement with the reception collar as soon as the reservoir is thrust against the reception collar, so as to provide easy and releasable fastening between the reservoir and the reception collar. This easily releasable snap-fastening does not have the function of connecting the reservoir to the dispenser member but merely the function of securing the reservoir to the collar, so as to avoid the reservoir accidentally falling out of the cylinder.

According to another advantageous characteristic of the invention, the reservoir includes connection means for establishing fluid-flow communication between the dispenser member and the reservoir, and air-flow communication between the reservoir and the outside.

The spirit of the invention resides in connecting the reservoir to the dispenser member (pump) in such a manner as to establish fluid- and air-flow communication with a very simple hand movement that consists merely in pressing on the bottom wall of the reservoir both for connection and for disconnection. The reception collar, the spring, and the cylinder make it possible to switch the ring between a locked position and an unlocked free position.

BRIEF DESCRIPTION OF THE DRAWINGS

The invention is described more fully below with reference to the accompanying drawings, which show an embodiment of the invention by way of non-limiting example.

In the figures.

DETAILED DESCRIPTION

Figure 1:
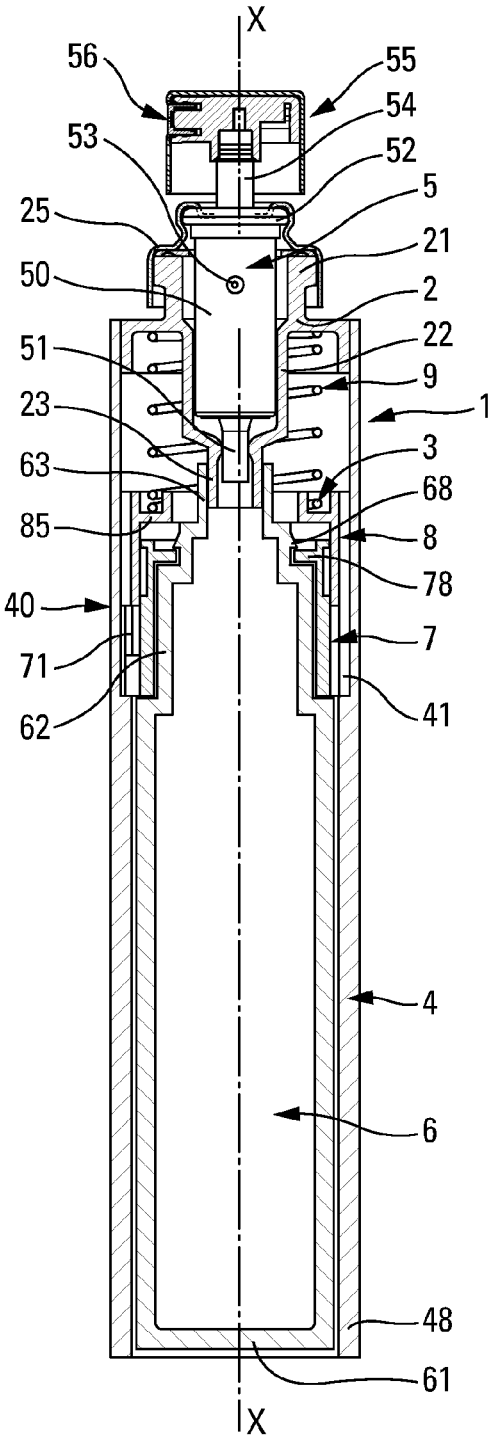
FIG. 1 is a vertical-section view through a fluid dispenser in a non-limiting embodiment of the invention.

Reference is made firstly to FIG. 1 in order to describe, in overall manner, the various component elements of a fluid dispenser in a non-limiting embodiment of the invention. The fluid dispenser comprises a casing 1; a fluid dispenser member 5; and a fluid reservoir 6. The dispenser member 5 is not a critical element of the present invention: its structure is thus not described in detail.

The dispenser member 5, which may be a manual pump, conventionally comprises a body 50 that forms a fluid inlet 51, and a top mounting rim 52 that projects radially outwards. The pump body 50 may also be provided with a vent hole 53. The dispenser member also comprises an actuator rod 54 that is axially movable down and up inside the pump body 50, so as to cause the volume of a fluid chamber to vary. The actuator rod 54 is covered by a pusher 55 that is provided with a dispenser orifice 56, e.g. in the form of a nozzle. This design is entirely conventional for a manual pump in the fields of perfumery, cosmetics, and even pharmacy.

The casing 1 is a part that may be made as a single piece by injection-molding plastics material, or from a plurality of pieces that are fitted together. The casing defines three distinct functional parts, namely: mounting means 2 for mounting the dispenser member 5; a cylinder 4 for housing the fluid reservoir 6; and connection means 3 for providing the connection between the reservoir 6 and the dispenser member 5. The connection means 3, which are described in detail below, comprise a reception collar 7, a ring 8, a spring 9, and a connection section 40 that is formed by the cylinder 4. The connection means 3 constitute the core of the invention. The connection section 41 of the cylinder 4 extends at the top portion of the cylinder that extends downwards until it reaches an insertion-and-removal opening 48 that gives access to the inside of the cylinder that thus defines an axis X.

The mounting means 2 preferably constitute a separate part that is fitted on the open top end of the cylinder 4. The mounting means 2 include an annular flange 21 around which a crimping cap 25 is mounted: The crimping cap 25 also extends around the rim 52 of the body 50 of the dispenser member 5. Below the flange 21, the mounting means 2 form a centering bushing 22 in which the body 50 is received as a tight fit. At their bottom end, the mounting means 2 form a connection sleeve 23 inside which there extends the fluid inlet 51 of the dispenser member 5, and outside which a connection tube 63 of the reservoir 6 comes to be connected. It should be observed that the vent hole 53 can communicate with the connection sleeve 23, such that the inside of the reservoir 6 is connected to the outside through the vent hole 53. In addition, the reservoir 6 is naturally in communication with the inside of the body 50 through the fluid inlet 51. The connection means 3 are preferably put into place in the cylinder 4 before the mounting means 2 are assembled on the cylinder 4.

The fluid reservoir 6 can be engaged in the cylinder 4 through an insertion and removal opening 48, axially along the axis X. The reservoir includes a bottom wall 61 that is accessible through the insertion and removal opening 48, as can be seen in FIG. 1. The bottom wall 61 is arranged substantially at the opening 48. The reservoir 6 presents a configuration that is generally substantially cylindrical, and that, at its top portion, defines a neck 62 that is received in the reception collar of the connection means 3. The neck 62 may even form a snap-fastener profile 68 for co-operating with a lip 78 of the reception collar 7 so as to provide easily releasable snap-fastening that merely makes it possible to secure the reservoir 6 to the collar 7 so that the reservoir 6 does not accidentally fall out of the cylinder 4. The weak snap-fastening between the profile 68 and the lip 78 does not guarantee connection between the reservoir 6 to the dispenser member 5. In its top end portion, the neck 62 forms a connection tube 63 that comes into leaktight engagement with the connection sleeve 23 of the mounting means 2.

The connection means 3 of the invention are described in detail below with reference to FIGS. 1 to 4. In FIG. 1, it can be seen that the neck 62 of the reservoir 6 is engaged inside the reception collar 7 that is itself engaged inside the connection section 40 of the cylinder 4. The connection section 40 can be seen more clearly in FIG. 2. The active portion of the connection section 40 is formed at its inner wall. Initially, a plurality of axial guide grooves 41 are formed in the inner wall. By way of example, provision may be made for six axial guide grooves 41, each of which includes a closed bottom end 42 and an open top end 43. Between two axial grooves 41 there is formed a locking-and-unlocking path 44 that comprises a locking section 45 and an unlocking section 47 that are separated by a stop section 46. The locking section 45 slopes downwards from the open top end 43 of the groove 41 until it reaches the stop section 46. The unlocking section 47 also slopes downwards from the top of the stop section 46 until it reaches the open top end 43 of the other groove 41. Thus, the connection section 40 internally forms six axial guide grooves 41 that are separated by six locking-and-unlocking paths, each of which comprises a sloping locking section 45 and a sloping unlocking section 47 that are separated by a stop section 46.

Figure 3:
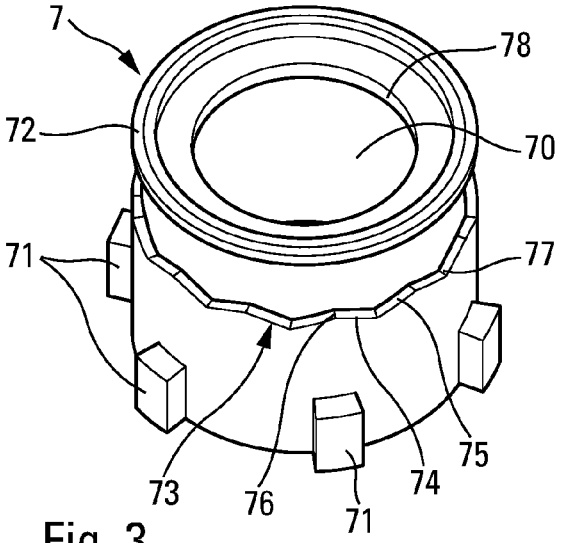
FIG. 3 is a perspective view of the reception collar of the dispenser.
Figure 2:
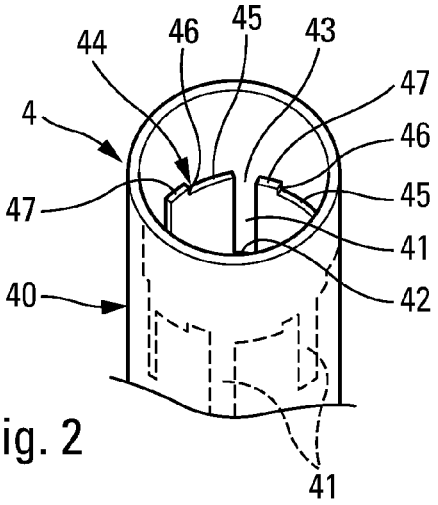
FIG. 2 is a perspective view of the top portion of the cylinder of the dispenser.

The reception collar 7 visible in FIG. 3 is received inside the connection section 40 of the cylinder 4 and around the neck 62 of the reservoir 6. The reception collar 7 defines an internal reception space 70 of shape and of configuration adapted to receiving the neck 62 of the reservoir 6. By way of example, provision may be made for the neck 62 to slide, with limited clearance, inside the space 70. The bottom end of the collar 7 is wide open so as to make it possible to insert and remove the neck 62, whereas its top end is closed a little and forms the lip 78 that may advantageously co-operate with the snap-fastener profile(s) 68 of the neck 62. Externally, from bottom to top, the reception collar 7 forms a plurality of guide tabs 71, in this embodiment six tabs, that correspond to the six axial guide grooves 41 of the connection section 40 of the cylinder 4. The guide tabs 71 are for engaging in the axial guide grooves 41 and for being held captive therein, so that the collar 7 may move axially only, without any turning component. Above the guide tabs 71, the outer wall of the collar 7 forms a crenelated annular edge 73 that comprises descending slopes 74 and rising slopes 75 that are separated by peaks 76 and troughs 77. The crenelated annular edge 73 is oriented upwards towards an annular rim 72 that projects radially outwards over the crenelated annular edge 73 with a certain amount of offset. The reception collar 7 may be made easily by injection molding an appropriate plastics material.

Figure 4:
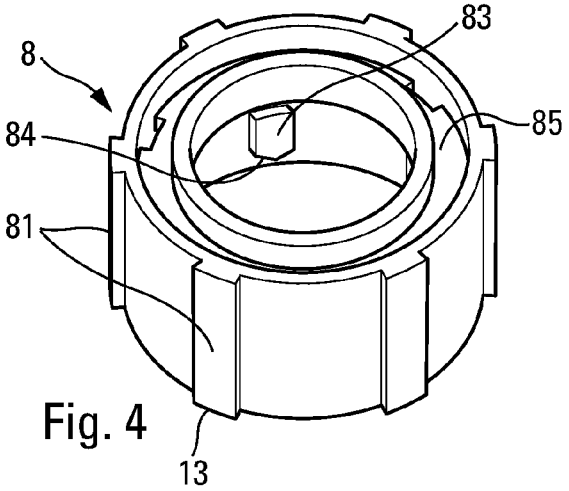
FIG. 4 is a perspective view of the ring of the dispenser.

The ring 8, visible in FIG. 4, presents a configuration that is generally substantially similar to the configuration of the reception collar 7, and is for engaging around the collar 7 inside the cylinder 4. Externally, the ring 8 includes guide splines 81, in this embodiment six splines, corresponding to the number of axial guide grooves 41 of the cylinder 4. The guide splines 81 are engaged in the axial guide grooves 41 of the cylinder 4, and may slide therein over a determined axial stroke that terminates at the open top end 43 of the grooves 41. Each guide spline 81 includes a bottom end, preferably sloping with an angle that corresponds to the slope of the locking and unlocking sections 45, 47 of the locking-and-unlocking paths 44 of the cylinder 4. The top end of the ring 8 forms an inwardly-directed shoulder 85 for receiving the spring 9, as can be seen in FIG. 1. Internally, the ring 8 forms a plurality of lugs 83 that are distributed over the inner periphery of the ring. Each lug 83 defines a bottom end in the shape of a chevron, presenting slopes at angles that correspond substantially to the angles of the descending and rising slopes 74, 75 of the crenelated annular edge 73 of the reception collar 7. The ring 8 may be made easily by injection molding an appropriate plastics material.

While the dispenser is being assembled, the reception collar 7 is firstly engaged inside the casing 1 via its open top end before assembling the mounting means 2. The collar 7 is engaged in the connection section 40 in such a manner that its guide tabs 71 engage axially in the axial guide grooves 41. By gravity, the tabs 71 bear against the bottom ends 42 of the grooves 41. The ring 8 is then engaged inside the casing in the same way as the reception collar 7. The guide splines 81 are also engaged in the axial guide grooves 41 of the connection section 40. The spring 9 is then inserted in the casing in such a manner that it bears against the shoulder 85 of the ring 8. Finally, the mounting means 2 are fitted on the open top end of the cylinder 4. The dispenser member 5 may then be mounted in the mounting means 2, if this has not already been done. The spring 9 acts between the mounting means 2 and the shoulder 85 of the ring 8. Thus, the ring 8 is thrust axially against the reception collar 7 or against the locking-and-unlocking paths 44, as described below.

When the reservoir 6 is inserted inside the cylinder 4, the neck 62 begins by being engaged inside the reception collar 7, possibly so as to provide easily releasable snap-fastening. By pressing on the bottom wall 61 of the reservoir 6, the reception collar 7 is moved inside the cylinder 4 against the force exerted by the spring 9. Given that the guide tabs 71 of the collar 7 are engaged inside the axial guide grooves 41 of the cylinder 4, the reception collar 7 can move only axially, without ever being able to turn about its own axis inside the cylinder. The guide tabs 71 are held captive in the grooves 41 and cannot be released therefrom. The ring 8 presents greater freedom of movement given that it can slide axially in the cylinder 4 when its guide splines 81 are engaged in the axial guide grooves 41, but it can also turn about its own axis inside the cylinder 4, by moving along the locking-and-unlocking paths 44. When the spring 9 urges the guide splines 81 fully into the grooves 41, the ring is in the free or unlocked position in which the reservoir 6 may be removed from the cylinder 4. In contrast, when the bottom ends 82 of the splines 81 are arranged on the locking sections 45 in abutment against the stop sections 46, the ring is in the locked position in which the reservoir 6 is connected to the dispenser member 5.

Figures 5A, 5B, 5C:
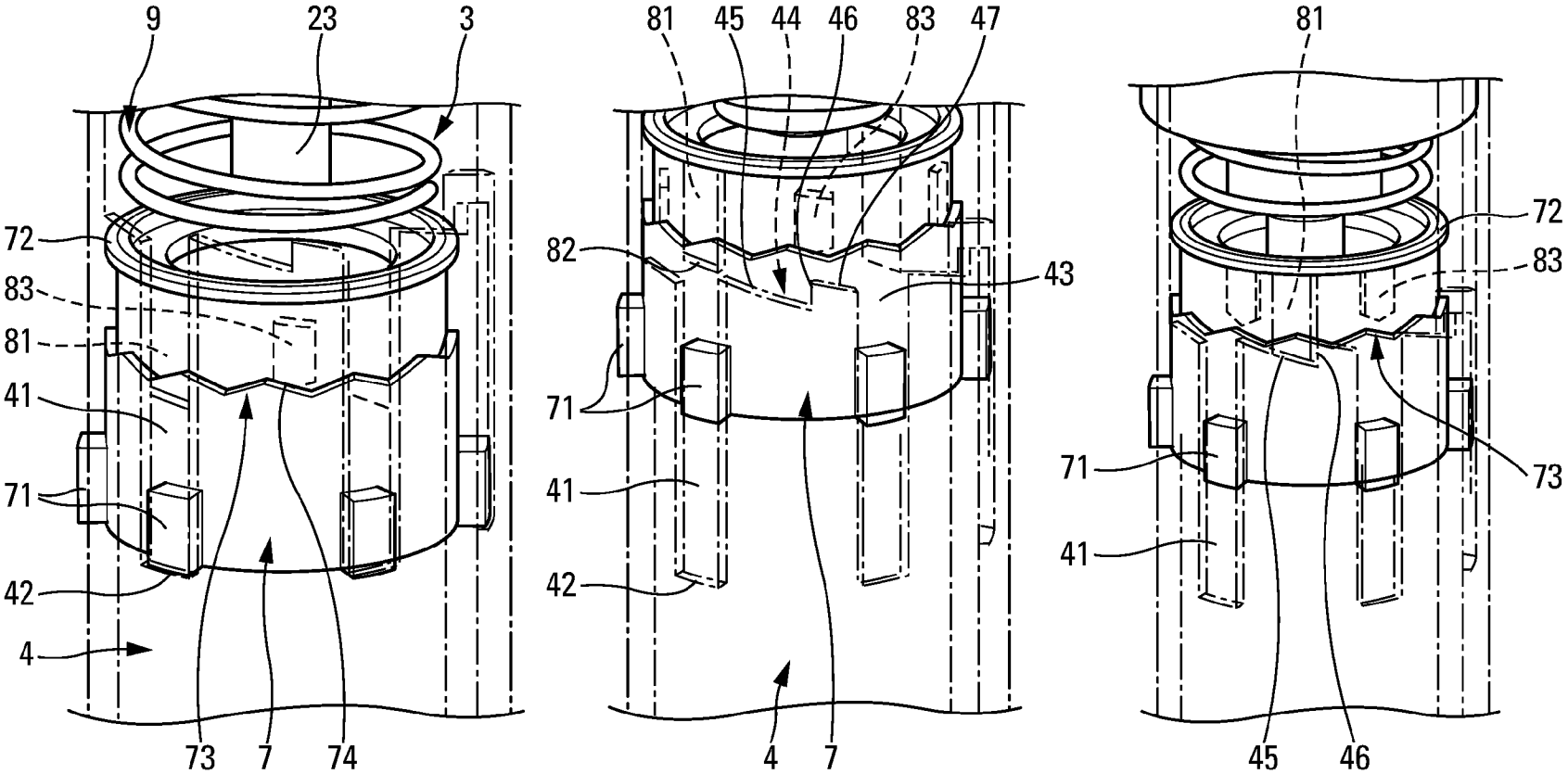
FIGS. 5*a*, 5*b*, and 5*c* are perspective and transparent views showing the relative positions of the reception collar and of the ring in the free position before insertion, in the fully depressed position, and in the locked position respectively.

Reference is made below to FIGS. 5*a*, 5*b*, and 5*c* to explain the path of a guide spline 81 from one axial guide groove 41 to an adjacent groove.

In FIG. 5*a*, the connection means 3 are in a rest configuration, before insertion of the reservoir, in which configuration the ring 8 is in the free or unlocked position. By way of example, it may be assumed that there is no reservoir 6 inside the cylinder 4. In this configuration, the guide tabs 71 are in abutment against the closed bottom ends 42 of the axial guide grooves 41 under the action of the spring 9 that bears against the ring 8 having lugs 83 that come into abutment against the descending slopes 74 of the crenelated annular edge 73. It should be observed that the bottom ends 82 of the guide splines 81 are at a distance from the guide tabs 71, while being engaged in the axial guide grooves 41. Thus, the ring 8 is prevented from turning in the cylinder 4, but it is however urged to turn by the engagement of the lugs 83 on the descending slopes 74 of the reception collar 7. In this configuration, the connection means 3 are ready to receive a fluid reservoir 6.

In FIG. 5*b*, the connection means 3 are in a configuration that corresponds to a reservoir 6 being fully inserted into the cylinder 4. In other words, the configuration corresponds to the moment when the user presses fully on the bottom wall 61 of the reservoir 6 starting from the free position. This is a configuration that is unstable and of short duration. The reception collar has been moved by the neck 62 of the reservoir 6 in such a manner that the guide tabs 71 have moved axially upwards in the grooves 41 of the cylinder. The axial movement of the collar 7 has caused an axial movement of the ring 8 over an axial stroke that is greater than the determined axial stroke, such that the bottom ends 82 of the guide splines 81 are situated beyond the open top ends 43 of the grooves 41. Thus, the splines 81 are released from the grooves 41, and under the turning action generated by the lugs 83 that bear against the descending slopes 74, the ring 8 can turn through a short distance until the lugs 83 reach the troughs 77. This small turning movement is sufficient to engage the bottom ends 82 of the guide splines 81 on the sloping locking sections 45 of the locking-and-unlocking paths 44. The user then relaxes the pressure applied to the bottom wall 61, such that the ring 8 is no longer thrust by the collar 7: the lugs 83 stop being in contact with the crenelated annular edge 73, and the advantageously sloping bottom ends 82 can come into sliding contact against the locking sections 45 under the action of the spring 9. The splines 81 then move over a determined angular stroke and slightly downwards by sliding over the sloping locking sections 45, until they come into abutment against the stop sections 46, as shown in FIG. 5*c*. The collar 7 has thus reached its locked position in which the connection tube 63 of the neck 62 of the reservoir 6 is connected in leaktight manner with the connection sleeve 23 of the mounting means 2. This is a stable position generated by the action of the spring 9 on the ring 8 that bears on the cylinder 4. The reception collar 7 is thus totally inactive. This can be seen from the intermediate position of the guide tabs 71 in the axial guide grooves 41 in FIG. 5*c*.

From the locked position in FIG. 5*c*, the user may once again press on the bottom wall 61 of the reservoir 6 so as to remove the reservoir 6 from the cylinder 4. By pressing on the bottom wall 61, the reception collar 7 is moved axially in such a manner as to re-establish contact between the lugs 83 and the crenelated annular edge 73. The guide splines 81 are thus moved a short distance along the stop sections 46 until they can be released. The ring 8 is then once again turned by the collar 7 as a result of the lugs 83 being in contact with the descending slopes 74 of the crenelated edge 73. This turning causes the ring to turn over an angular stroke that is limited, but sufficient to position the guide splines 81 over the unlocking sections 47. The user may then relax the pressure on the bottom wall 61, such that the bottom ends 82 of the splines 81 come into sliding contact on the sloping unlocking sections 47, and the lugs 83 lose contact with the crenelated annular edge 73. The splines may thus slide along the sloping unlocking sections until they drop, under the action of the spring 9, into the axial guide grooves 41 in the position shown in FIG. 5*a*. A complete operating cycle has thus been accomplished.

Figure 6A:
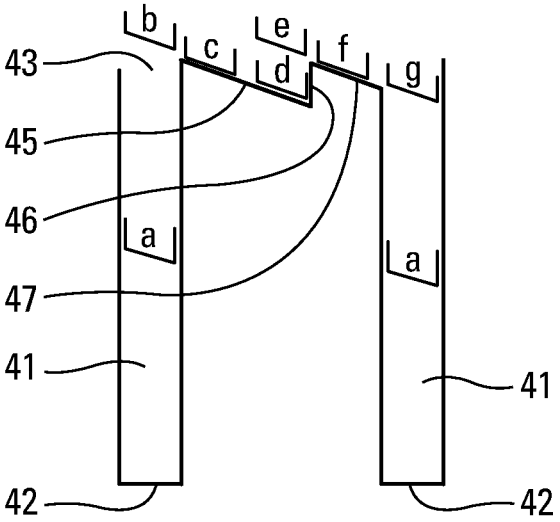
FIGS. 6*a*, 6*b*, and 6*c* are diagrammatic views seeking to show the relative positions of certain elements of the collar and of the ring during a complete cycle of inserting and removing a reservoir.
Figure 6B:
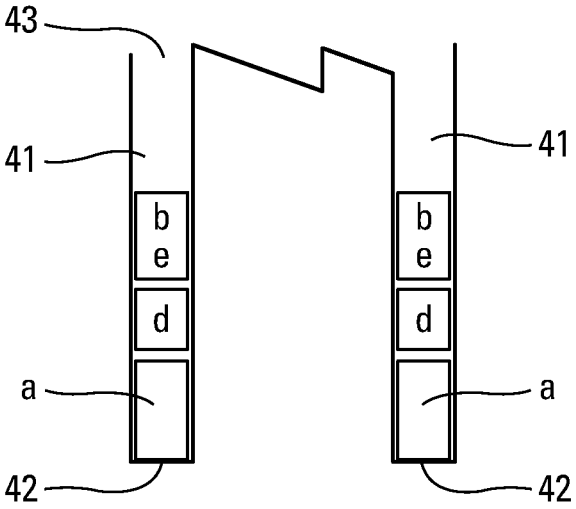
Figure 6C:
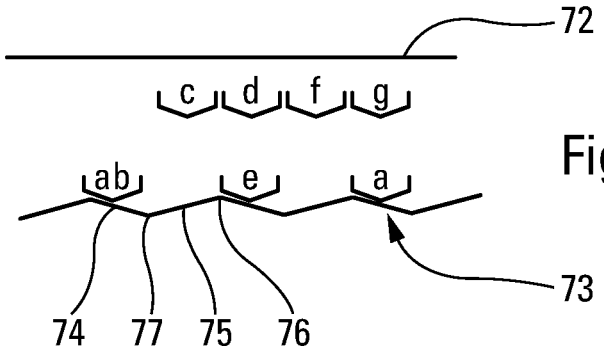

Reference is made below to FIGS. 6*a*, 6*b*, and 6*c* simultaneously, in order to describe very succinctly the respective paths of the bottom end 82 of a guide spline 81, of the guide tabs 71, and of the lugs 83, during a complete operating cycle.

FIG. 6*a* breaks down the path of the bottom end 82 of a guide spline 81 into several steps from one groove 41 to the adjacent groove. In this embodiment, the path has been broken down into eight steps or positions that are identified by the letters a to g. The start and end position a corresponds to the FIG. 5*a* configuration in which the ring 8 has only the spring 9 acting thereon. The bottom end 82 of the spline 81 is arranged in an axial guide groove 41. By pressing on the bottom wall 6 of the reservoir, the bottom end 82 is moved into position b, beyond the open top end 43 of the groove 41. As a result of the turning exerted by the collar 7 as a result of camming contact between the lugs 83 and the crenelated annular edge 73, the bottom end 82 is moved from position b to position c. The pressure on the bottom wall of the reservoir 61 is then relaxed and the bottom end is then urged by the spring 9 over the sloping locking section 45 in such a manner that the rib 81 moves along the sloping section until it comes into abutment against the stop section 46 in position d. The locked position is thus achieved, in which position the reservoir is connected to the dispenser member 5 and is in both fluid- and air-flow communication therewith. The user may then use the dispenser to dispense doses of fluid. When the reservoir is empty and the user wishes to remove the reservoir, the user presses once again on the bottom wall 61 of the reservoir in such a manner as to move the collar 7 towards the ring 8 so as to move the bottom end 82 from position d to position e in which it is released from the stop section 46. However, given that the lugs 83 are once again in camming contact with the descending slopes 74, the collar causes the ring to turn, and the ring can then engage on the unlocking section 47, corresponding to position f. The pressure on the bottom wall 61 of the reservoir may be relaxed, such that the bottom end 82 comes into sliding contact against the unlocking section 47. The guide spline 81 thus slides along the unlocking section 47 until it reaches the open top end 43 of the adjacent groove 41, corresponding to position g. From there, the spring 9 causes the spline 81 to slide into the groove 41 until it reaches the free or unlocked final position that is the same as the start position a. A complete operating cycle has thus been accomplished.

In FIG. 6*b*, the paths of two guide tabs 71 in two adjacent axial guide grooves 41 can be seen. The guide tabs 71 move between three different stable positions during the complete operating cycle. With reference to FIG. 6*a*, there are four stable positions, namely positions a, b, d, and e. In the initial and final position a, the tabs 71 are in abutment against the closed bottoms 42 of the grooves 41. In the fully depressed positions of the reservoir 6 corresponding to positions band e, the tabs 71 are in their highest positions in the grooves 41. Finally, in the stable locked position corresponding to position d, the tabs 71 are in an intermediate position.

FIG. 6*c* shows the position of a lug 83 relative to the rim 72 and to the crenelated annular edge 73 in the various positions a to g. In positions a, b, and e, the lug 83 is in cam contact with a descending slope 74 of the crenelated annular edge 73, and this urges the ring 8 to turn. In contrast, in positions c, d, f, and g, the lug 83 is spaced apart from the crenelated annular edge 73, such that the ring is not urged to turn by the collar, the ring merely being subjected to the action of the spring.

By means of the connection means 3 of the invention, that use only a collar 7, a ring 8, a spring 9, and a connection section 40 formed by the cylinder 4, it is possible to connect a fluid reservoir 6, that is in the form of a cartridge or a refill, to a dispenser member 5 so as to establish fluid-flow communication and possibly also air-flow communication merely by pressing on the bottom wall of the reservoir 61 that is accessible at an insertion-and-removal opening of the cylinder 4. Each time the bottom wall 61 is pressed, the ring 8 switches between a stable position in which it is guaranteed to be locked to a stable position in which it is guaranteed to be unlocked or free.

What is claimed is:

1. A fluid dispenser comprising:

a casing comprising mounting means, connection means, and a cylinder provided with an insertion-and-removal opening and defining an insertion and removal axis X;

a dispenser member, such as a pump or a valve, that is received in the mounting means; and a fluid reservoir that is engaged in the cylinder through the insertion-and-removal opening, and that is connected to the dispenser member in removable manner by means of the connection means, the reservoir including a bottom wall that is accessible at the insertion-and-removal opening;

the dispenser being characterized in that the connection means comprise a reception collar in which a portion of the reservoir is received, the reception collar being guided in axial movement in the cylinder along the insertion and removal axis X against the action of a spring, the connection means further comprising a ring that is arranged between the reception collar and the spring, the ring coming into engagement both with the cylinder and the reception collar so as to respond to pressure being applied against the bottom wall of the reservoir, by switching between a locked position in which the reservoir is connected to the dispenser member, and a free position in which the reservoir may be removed from the cylinder.

2. A dispenser according to claim 1, wherein the ring is mounted to turn relative to the reception collar and to the cylinder, the reception collar urging the ring to turn when the reception collar is thrust axially against the ring.

3. A dispenser according to claim 2, wherein the ring is guided in axial movement in the cylinder over a determined axial stroke, the ring being released from the axial guidance when the reception collar is thrust axially against the ring over a stroke that is greater than the determined axial stroke.

4. A dispenser according to claim 3, wherein the cylinder urges the ring to turn over a limited angular stroke when it is released both from the axial guidance of the cylinder and from the axial thrust of the reception collar.

5. A dispenser according to claim 1, wherein the cylinder includes axial guide grooves that are distributed over an inner wall, the reception collar including guide tabs that are engaged in the axial guide grooves of the cylinder, such that the reception collar slides axially in the cylinder without any turning component.

6. A dispenser according to claim 5, wherein the ring includes guide splines that are engaged in the axial guide grooves of the cylinder above the guide tabs, each axial guide groove presenting an open top end, the guide splines being moved beyond the open top ends so that the ring is released from the axial guidance of the cylinder.

7. A dispenser according to claim 6, wherein the open top ends of the axial guide grooves are interconnected by locking-and-unlocking paths over which the guide splines of the ring pass under the action of the spring as soon as the axial thrust of the reception collar is relaxed, the guide splines being released from the axial guide grooves by the axial thrust of the reception collar that turns the ring so that its guide splines engage on the locking-and-unlocking paths as soon as they are released from the axial guide grooves of the cylinder.

8. A dispenser according to claim 7, wherein the reception collar includes a crenelated annular edge having descending slopes that are separated by peaks and troughs, the ring that are engaged on the descending slopes when the reception collar is thrust axially against the ring, in such a manner as to urge the ring to turn relative to the reception collar.

9. A dispenser according to claim 7, wherein each locking-and-unlocking path comprises a sloping locking section and a sloping unlocking section that are separated by a stop section, each of the locking-and-unlocking sections communicating with a directly-adjacent axial guide groove, the guide splines of the ring presenting bottom ends that are advantageously sloping and that slide, from their free position, into the axial guide grooves under the axial thrust of the reception collar, that engage, on leaving the axial guide grooves, against the locking sections under the turning action of the reception collar, that slide over the locking sections under the action of the spring, that are blocked by the stop sections in the locked position, that are moved axially by the axial thrust of the reception collar, that engage against the unlocking sections under the turning action of the reception collar, that slide over the unlocking sections under the action of the spring, and that then engage in the axial guide grooves under the action of the spring, into their free position.

10. A dispenser according to claim 1, wherein the reservoir includes a fastener profile that is suitable for coming into releasable engagement with the reception collar as soon as the reservoir is thrust against the reception collar, so as to provide easy and releasable fastening between the reservoir and the reception collar.

11. A dispenser according to claim 1 wherein the reservoir includes connection means for establishing fluid-flow, and possibly air-flow, communication between the dispenser member and the reservoir.

* * * * *